US009573045B2

(12) United States Patent
Lai

(10) Patent No.: US 9,573,045 B2
(45) Date of Patent: Feb. 21, 2017

(54) SKATEBOARD ASSEMBLY

(71) Applicant: Po-Chih Lai, Kaohsiung (TW)

(72) Inventor: Po-Chih Lai, Kaohsiung (TW)

( * ) Notice: Subject to any disclaimer, the term of this patent is extended or adjusted under 35 U.S.C. 154(b) by 0 days.

(21) Appl. No.: 14/555,869

(22) Filed: Nov. 28, 2014

(65) Prior Publication Data

US 2016/0151699 A1 Jun. 2, 2016

(51) Int. Cl.
*A63C 17/01* (2006.01)
*A63C 17/16* (2006.01)

(52) U.S. Cl.
CPC ..... *A63C 17/16* (2013.01); *A63C 17/012* (2013.01); *A63C 17/014* (2013.01); *A63C 2201/02* (2013.01)

(58) Field of Classification Search
CPC ..... A63C 17/01; A63C 17/011; A63C 17/012; A63C 17/0093; A63C 17/014; A63C 17/015; A63C 17/12
See application file for complete search history.

(56) References Cited

U.S. PATENT DOCUMENTS 3,023,022 A * 2/1962 Boyden ..... A63C 17/004 280/11.19
4,062,557 A * 12/1977 Roden ..... A63C 17/01 280/11.27
4,337,961 A * 7/1982 Covert ..... A63C 17/01 280/844
4,645,223 A * 2/1987 Grossman ..... A63C 17/0046 280/11.28
5,819,865 A * 10/1998 Cowley ..... A63C 5/08 180/185
6,158,753 A * 12/2000 Sturbaum ..... A63C 17/01 280/11.225
6,206,390 B1 * 3/2001 Borg ..... A63C 17/01 280/268
6,474,666 B1 * 11/2002 Andersen ..... A63C 17/0093 280/11.28
6,793,224 B2 * 9/2004 Stratton ..... A63C 17/012 280/87.041
8,807,577 B2 * 8/2014 Lai ..... B62M 1/00 280/11.28
8,915,506 B2 * 12/2014 Piaceski ..... A63C 17/0033 280/11.27
2003/0141688 A1 * 7/2003 Lynn ..... A63C 17/0093 280/87.042

* cited by examiner

*Primary Examiner* — Emma K Frick
(74) *Attorney, Agent, or Firm* — Ming Chow; Sinorica, LLC

(57) ABSTRACT

A skateboard assembly is provided, including: a base plate having a plurality of first through holes, an ear part formed on the base plate, a second through hole formed on an end of the ear part corresponding to the base plate, a first stopping part formed on an inner periphery of the second through hole, and a protruding part formed on the base plate and having a first groove. The ear part and the protruding part are disposed on a same side of the base plate. The second through hole has a cross section orthogonal to the base plate. The skateboard assembly further comprises buffer members, retaining members, wheel frames, keels and plates, which are assembled and coupled together by a plurality of fastening members, such that the skateboard is assembled.

12 Claims, 5 Drawing Sheets

SKATEBOARD ASSEMBLY

BACKGROUND OF THE INVENTION

1. Field of the Invention

The present invention relates to a skateboard assembly.

2. Description of Related Art

A conventional skateboard is composed of a plate, a base plate, trucks having through holes, fastening levers passing through the through holes of the trucks and fastening the trucks to the base plate, buffer members disposed between the fastening levers and the through holes, and wheels pivotally mounted on two ends of the trucks.

The conventional skateboard is designed to slide on even roadways. The buffering members, though facilitating veer of the skateboard, cannot help the skateboard to slide on uneven roadways, not to mention stairs.

Hence, it would be a task for manufacturers in the art to provide a skateboard assembly, so as to allow users to use the skateboard on uneven roadways, and particularly, stairs.

SUMMARY OF THE INVENTION

In order to solve the foregoing drawbacks of the conventional technology, the present invention provides a skateboard assembly comprising: a base plate having a plurality of first through holes formed on a periphery thereof; an ear part formed on the base plate, an end of the ear part corresponding to the base plate in position having a second through hole, wherein a first stopping part is annularly formed on an inner periphery of the second through hole; and a first protruding part formed on the base plate and having a first groove, wherein the ear part and the first protruding part are formed on a same side of the base plate, and the second through hole has a cross section orthogonal to the base plate.

In an embodiment, the skateboard assembly further comprises trucks, each of which comprising: a second protruding part formed on a side of the truck; a third through hole formed on a side of the truck corresponding to the second protruding part, wherein a second stopping part is formed on an inner periphery of the third through hole; two axial segments disposed perpendicular to and outwardly extending from the trucks, wherein a first retaining member is disposed on each of the axial segments close to the trucks; a first buffer member having a second groove mounted onto a front end of the second protruding part; a second buffer member having a through hole; a third buffer member having a through hole; a first shim having a through hole; a second shim having a through hole; a first fastening member; and a second fastening member coupled with the first fastening member, so as to fastening the trucks to the base plate, wherein the base plate has a third groove, a fourth through hole is formed on a side of the ear part facing the first protruding part, and the third groove communicates with the fourth through hole.

In an embodiment, the first buffer member is formed in the first groove, the second protruding part is received in the second groove, and the first fastening member passes through the through hole of the first shim, the through hole of the second buffer member, the third through hole, the through hole of third buffer member, the through hole of the second shim, and the fourth through hole, protrudes into the third groove, and is fastened to the second fastening member.

In an embodiment, the skateboard assembly further comprising a wheel frame, the wheel frame comprising: a pivot hole pivotally coupled with the axial segments, and a side of the pivot hole facing the truck having a second retaining member corresponding with the first retaining member in position; and first and second segments extending from two sides of the pivot hole, respectively, wherein an angle is formed between the first segment and the second segment, and wheel axles are formed on the first segment and the second segment away from the pivot hole; a third shim having a through hole; a fourth shim having a through hole; a fourth buffer member having a through hole and interposed between the third shim and fourth shim; and a third fastening member.

In an embodiment, the axial segments are inserted in the pivot hole, the through hole of the third shim, the through hole of the fourth buffer member, and the through hole of the fourth shim, and engaged with the third fastening member, the wheel frame is pivotally engaged with the axial segment, and the first retaining member and the second retaining member limit axial rotation of the wheel frame with respect to the truck.

In an embodiment, the skateboard assembly further comprises a plurality of wheels pivotally engaged with the corresponding wheel axle.

In an embodiment, the skateboard assembly further comprises: a keel having fifth through holes on opposing ends thereof, wherein a third stopping part is formed on an inner periphery of the fifth through hole; a fifth buffer member having a through hole; a fifth shim having a through hole; a fourth fastening member; and a fifth fastening member.

In an embodiment, the fifth buffer member has two opposing sides abutting against the first stopping part and the fifth shim, respectively, the other side of the fifth shim opposing the side of the fifth shim abutting against the fifth buffer member abuts against the third stopping part, the fourth fastening member passes through the fifth through hole, the through hole of the fifth shim, and the through hole of the fifth buffer member, and coupled with the fifth fastening member, and the keel is fastened the ear part.

In an embodiment, the skateboard assembly further comprises: a plate having a sixth through hole and a plurality of seventh through holes; and a plurality of sixth fastening members; and a plurality of seventh fastening members, wherein the sixth fastening members pass through the seventh through holes and the first through holes corresponding in position to the seventh through holes, and are coupled with the seventh fastening members, allowing the plate to be fastened to the base plate.

In comparison with the conventional technology, the skateboard assembly according to the present invention, through coupling the keel to the base plate, enables the skateboard to be used on uneven roadways. Besides, together with the wheel axle, trucks, buffer members, retaining members and wheels to form the skateboard assembly, the user can use the skateboard on uneven roadways with higher stability.

DETAILED DESCRIPTION OF THE PREFERRED EMBODIMENTS

In the following description, for purposes of explanation, specific numbers, materials and configurations are set forth in order to provide a thorough understanding of the present invention. However, it will be apparent to one of ordinary skill in the art that the present invention may be practiced without specific details. In other instances, well-known systems are shown in diagrammatic or block diagram form in order not to obscure the present invention.

Figure 1A:
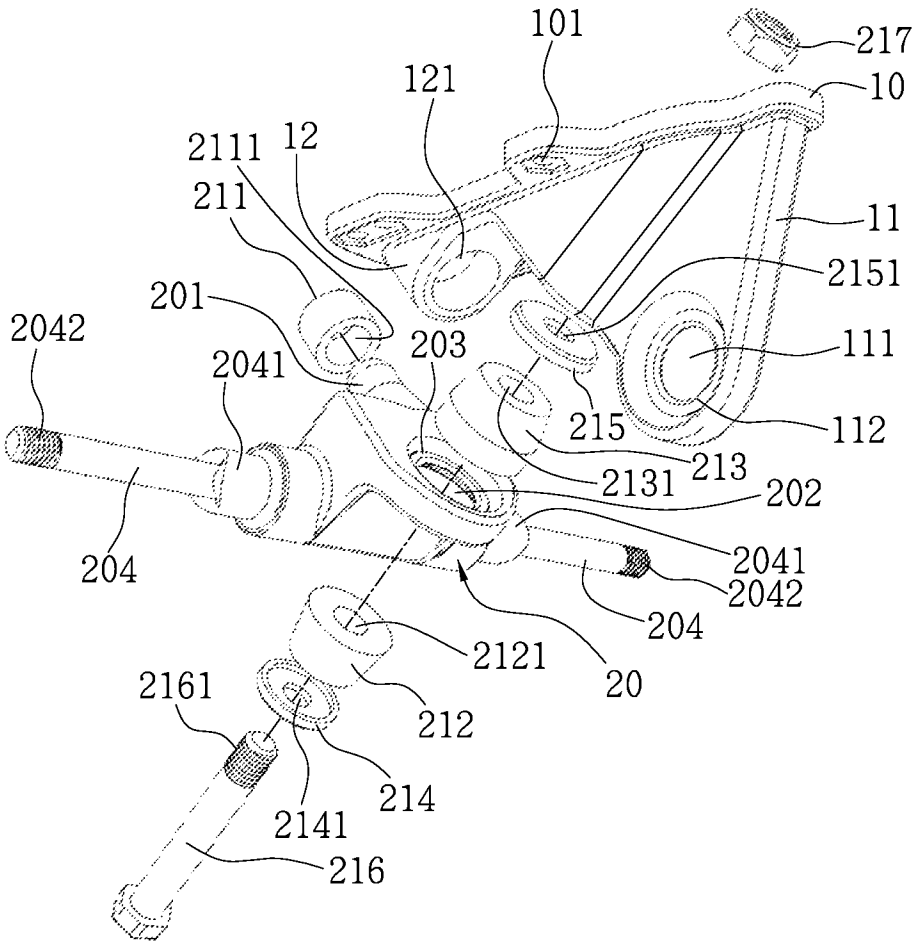
FIGS. 1A and 1B are exploded views showing a base plate and a truck of a skateboard assembly according to the present invention.
Figure 1B:
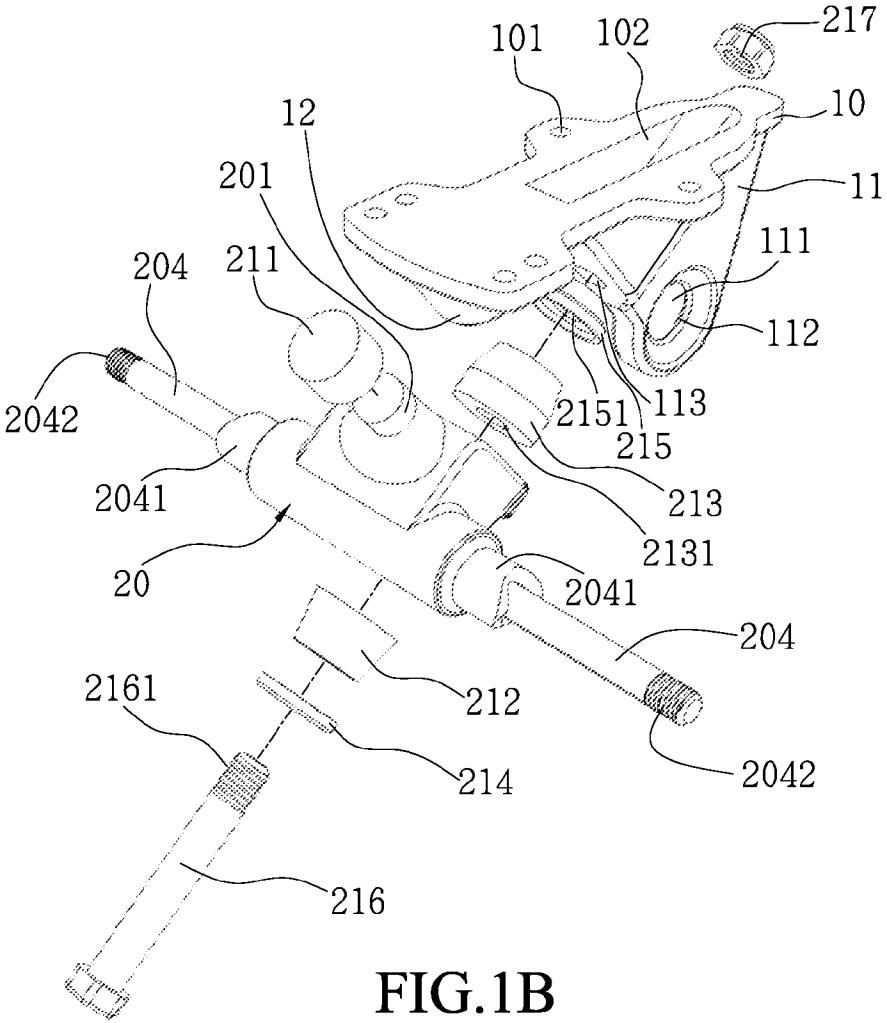

Referring to FIGS. 1A and 1B, a skateboard assembly according to the present invention comprises a base plate 10, an ear part 11, a first protruding part 12, and a truck 20.

In an embodiment, the base plate 10 has a board structure, and a plurality of first through holes 101 formed on a periphery thereof, and a number of the first through holes 101 can be adjusted according to practical needs. For instance, three first through holes 101 are formed on one side of the base plate 10, and another three first through holes 101 has are formed on the other side of the base plate 10. Besides, the base plate 10 is formed with a third groove 102.

The ear part 11 is formed on the base plate 10, and a second through hole 111 is formed on an end of the ear part 11 corresponding to the base plate 10 in position. A first stopping part 112 is formed on an inner periphery of the second through hole 111. In an embodiment, the ear part 11 extends from a side of the base plate 10 and is orthogonal to the base plate 10, and the cross section surface of the second through hole 111 is orthogonal to a surface of the ear part 11 of the base plate 10.

The first protruding part 12 is formed on the same side of the base plate as the ear part 11. The first protruding part 12 has a first groove 121. In an embodiment, the first protruding part 12 has a wedge structure, and the first groove 121 is formed on a side of the first protruding part 12 facing the ear part 11.

The side of the ear part 11 facing the first protruding part 12 is formed with a fourth through hole 113. The third groove 102 communicates with the fourth through hole 113.

The truck 20 comprises a second protruding part 201, a third through hole 202, a second stopping part 203, two axial segments 204, a first buffer member 211, a second buffer member 212, and a third buffer member 213.

The second protruding part 201 is formed on a side of the truck 20. The third through hole 202 is formed on a side of the truck 20 opposing the second protruding part 201, and a second stopping part 203 is formed on an inner periphery of the third through hole 202.

The two axial segments 204 are perpendicular to and extend outwardly from the truck 20, first retaining members 2041 are formed on the two axial segments 204 close to the truck 20. In an embodiment, the first retaining member 2041 is made of an elastic material, such as rubber or nylon. A thread 2042 is formed at a corresponding one end of the two axial segments 204, opposite to the first retaining member 2041.

The first buffer member 211 has a second groove 2111 mounted onto a front end of the second protruding part 201 and covering a portion of the second protruding part 201.

The second buffer member 212 and third buffer member 213 have through holes 2121 and 2131, respectively. In an embodiment, the second buffer member 212 and third buffer member 213 are made of an elastic material, such as rubber or nylon. In an embodiment, the second buffer member 212 and the third buffer member 213 are in the shape of a truncated cone, with one end tapered towards the other end. In another embodiment, the second buffer member 212 and the third buffer member 213 are in the shape of a column such as a cylinder.

The first shim 214 and the second shim 215 further have through holes 2141 and 2151, respectively, and the through holes 2141 and 2151 have cross sections corresponding to the through holes 2121 and 2131, respectively.

In an embodiment, the first fastening member 216 is a screw having a size corresponding to the through holes 2141 and 2151 and through holes 2121 and 2131, and a thread 2161 formed on a front portion thereof, and the second fastening member 217 is a nut corresponding to the first fastening member 216, such that the second fastening member 217 is fastened to the first fastening member 216.

In an embodiment, the first buffer member 211 is mounted in the first groove 121, and the second protruding part 201 is received in the second groove 2111. One side of each of the second buffer member 212 and third buffer member 213 having a cross section greater than the other side abuts the corresponding sides of the second stopping part 203. The first fastening member 216 passes through the through hole 2141 of the first shim 214, the through hole 2121 of the second buffer member 212, the third through hole 202, the through hole 2131 of the third buffer member 213, the through hole 2151 of the second shim 215, and fourth through hole 113, protrudes into the third groove 102, and fastened to the second fastening member 217, so as to fasten the truck 20 to the base plate 20.

Figure 2:
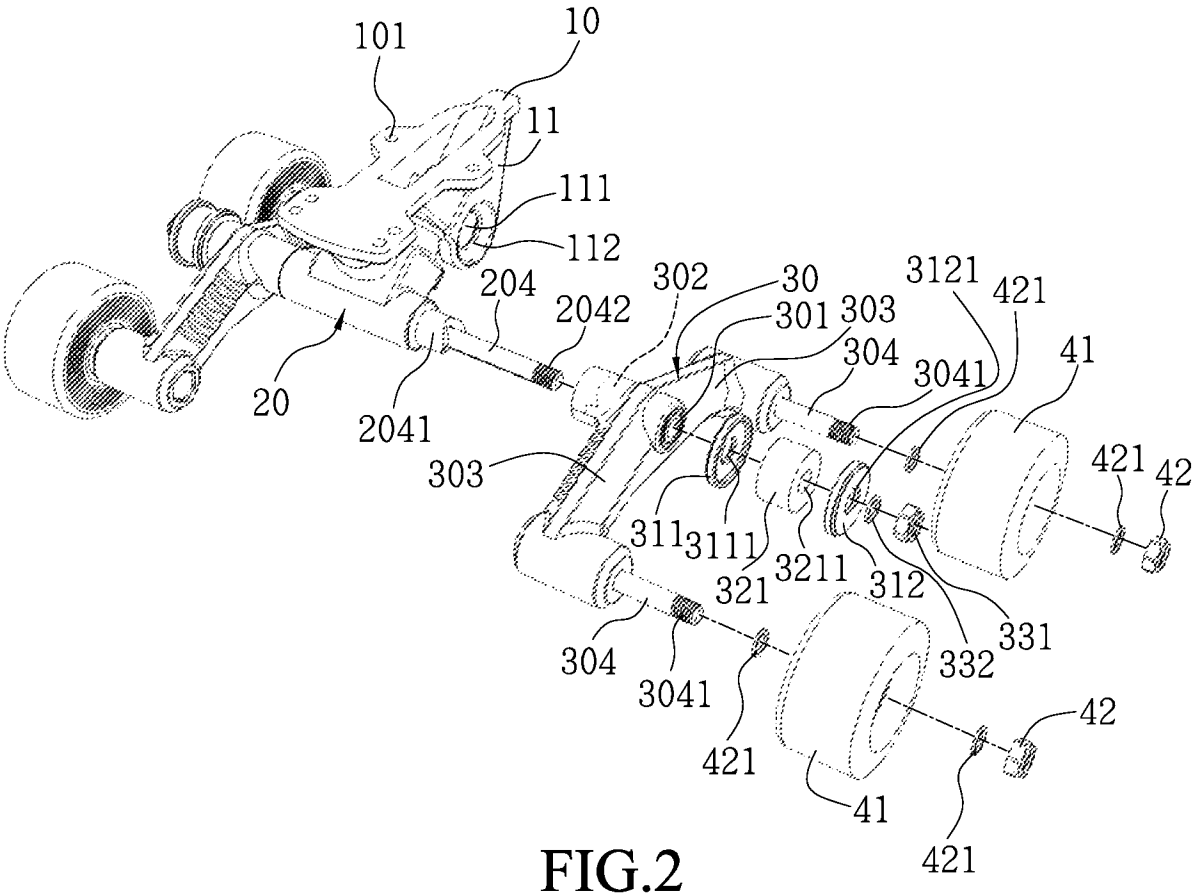
FIG. 2 is an exploded view showing a base plate, trucks, a wheel axle and wheels of a skateboard assembly according to the present invention.

Referring to FIG. 2, the skateboard assembly according to the present invention further comprises a wheel frame 30. A wheel frame 30 comprises a pivot hole 301, and two segments 303 extending at two sides of the pivot hole 301.

The pivot hole 301 is used to be pivotally coupled with the axial segment 204. A side of the pivot hole 301 facing the truck 20 has a second retaining member 302 corresponding to the first retaining member 2041 in position. As shown in FIG. 2, in an embodiment the two opposing sides of the first retaining member 2041 can be a curve tapered structure from the adjacent two sides, the second retaining member 302 can be an identical structure as the first retaining member 2041, and the second retaining member 302 rotates 90 degrees and is disposed in the pivot hole 301.

The two segments 303 form an angle. A wheel axle 304 is formed on one end of each of the two segments 303 away from the pivot hole 301.

The third shim 311 has a through hole 3111. The fourth shim 312 has a through hole 3121. The fourth buffer member 321 has a through hole 3211 and is interposed between the third shim 311 and the fourth shim 312. The through hole 3111, the through hole 3121 and the through hole 3211 can have the same cross section. The fourth buffer member 321 can be in the shape of a truncated cone or a cylinder, and can be made of an elastic material, such as rubber or nylon.

The third fastening member 331 can be a nut corresponding to the thread 2042 of the axial segment 204.

In an embodiment, the axial segment 204 passes through the pivot hole 301, the through hole 3111, the through hole 3211 and the through hole 3121, and is engaged with the third fastening member 331, allowing the wheel frame 30 to be pivotally coupled to the axial segment 204. The first retaining member 2041 and second retaining member 302, since having corresponding curved structures, limit the axial rotation of the wheel frame 30 with respect to the truck 20.

In an embodiment, the skateboard assembly according to the present invention further comprises a plurality of wheels 41, and a thread 3041 is formed on one end of the wheel axle 304 corresponding to the segment 303 in position, such that the wheels 41 are pivotally coupled to the corresponding wheel axle 304 through the coupling of the fourth fastening member 42 with thread 3041.

Accordingly, since the two segments 303 form an angle, an angle less than 180 degree, e.g., 170 or 160 degrees, is formed by the wheel frame 30 towards the ground, such that the wheel frame 30 appears to be V-shaped.

A fifth shim 332 is interposed between the fourth shim 312 and the third fastening member 331, and sixth shims 421 are formed between the wheel 41 and wheel axle 304 and at the wheel 41 and at the fourth fastening member 42.

Figure 3:
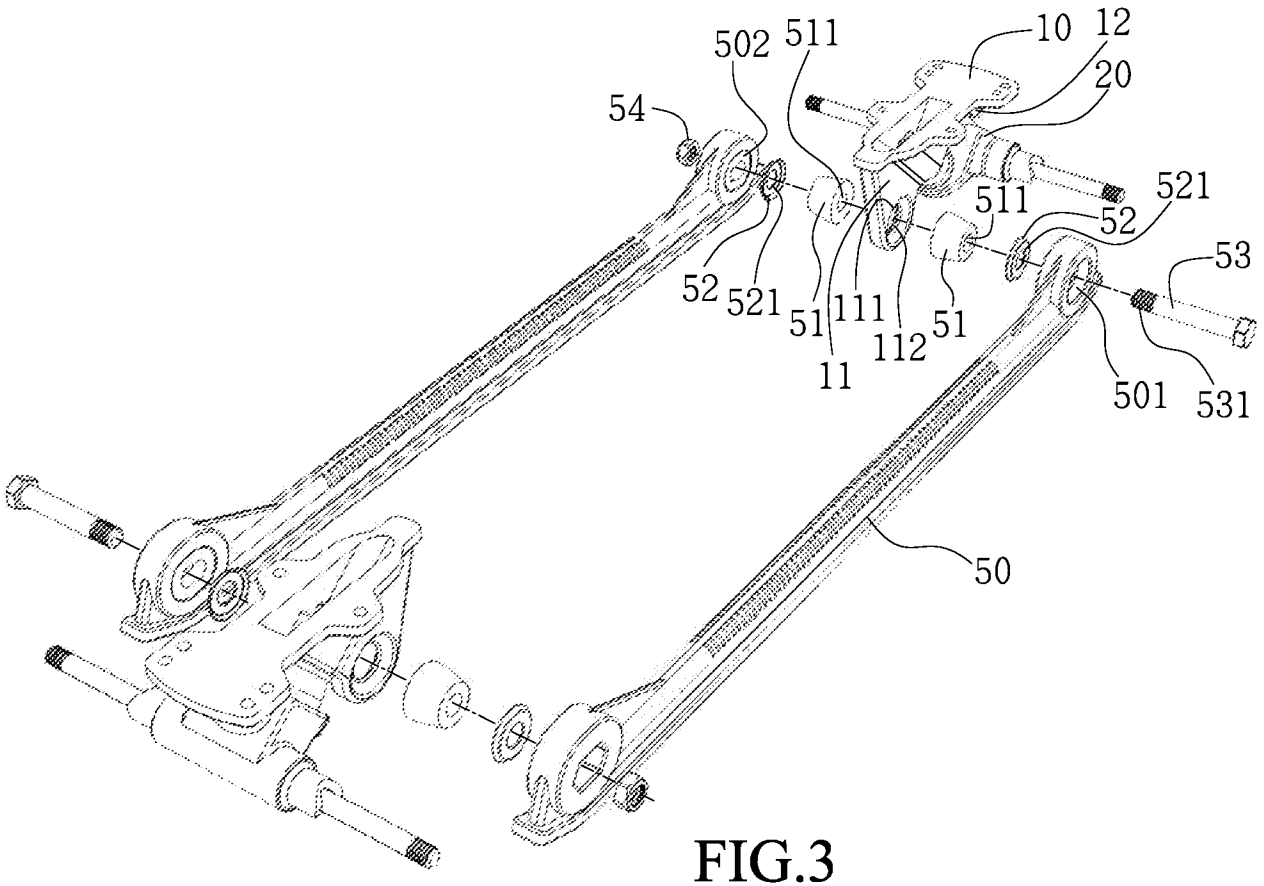
FIG. 3 is an exploded view showing a base plate, trucks, a wheel axle, wheels and a keel of a skateboard assembly according to the present invention.

Referring to FIG. 3, the skateboard assembly according to the present invention further comprises a keel 50, a fifth buffer member 51, a seventh shim 52, a fourth fastening member 53, and a fifth fastening member 54.

Fifth through holes 501 are formed on two opposing ends of the keel 50, and a third stopping part 502 is formed at an inner periphery of each of the fifth through holes 50. In an embodiment, the two keels 50 are coupled to the two base plates 10, each of which has a truck 20. The means of coupling will be described in the latter session.

The fifth buffer member 51 has a through hole 511. The fifth shim 52 has a through hole 521. In an embodiment, the two keels 50 are coupled to the two trucks 20 and two base plates 10. An embodiment is exemplified by the four fifth buffer members 51 with the four fifth shims 52. The fifth buffer member 51 can be made of an elastic material, such as rubber or nylon. The fifth buffer member 51 can be in the shape of a truncated cone or a column such as a cylinder.

The present invention can comprise any number of keels 50, and the number of the fifth buffer members 51 and the fifth shims 52 can be adjusted according to the number of the keels 50 coupling with the truck 20 and the base plate 10.

The fourth fastening member 53 can be a screw having a size corresponding to the second through hole 111, the through holes 511 and 521, and a thread 531 disposed on a front end thereof, and the fifth fastening member 54 can be a nut corresponding to the fourth fastening member 216, such that the fifth fastening member 54 is engaged with and fastened to the fourth fastening member 53.

Accordingly, when the two keels 50 are to be engaged with the two trucks 20 and the two base plates 10, the sides of the two fifth buffer members 51 having greater cross sections abut the first stopping parts 112, and the other sides of the two fifth buffer members 51 opposing the first stopping parts 112 abut the corresponding fifth shims 52. Two fifth shims 52 are on the other sides that the fifth buffer 51 abuts, which abut to a corresponding third stopping portion 502 of each keel 50, respectively. The fourth fastening members 53 pass through the fifth through holes 501, the through hole 511 of the fifth buffer members 51, and the through holes 521 of the fifth shims 52, and are coupled with the fifth fastening member 54, allowing front and back ends of the two keels 50 to be coupled to the two ear parts 11, respectively, so as to couple the two base plates 10 with the two trucks 20.

Figure 4:
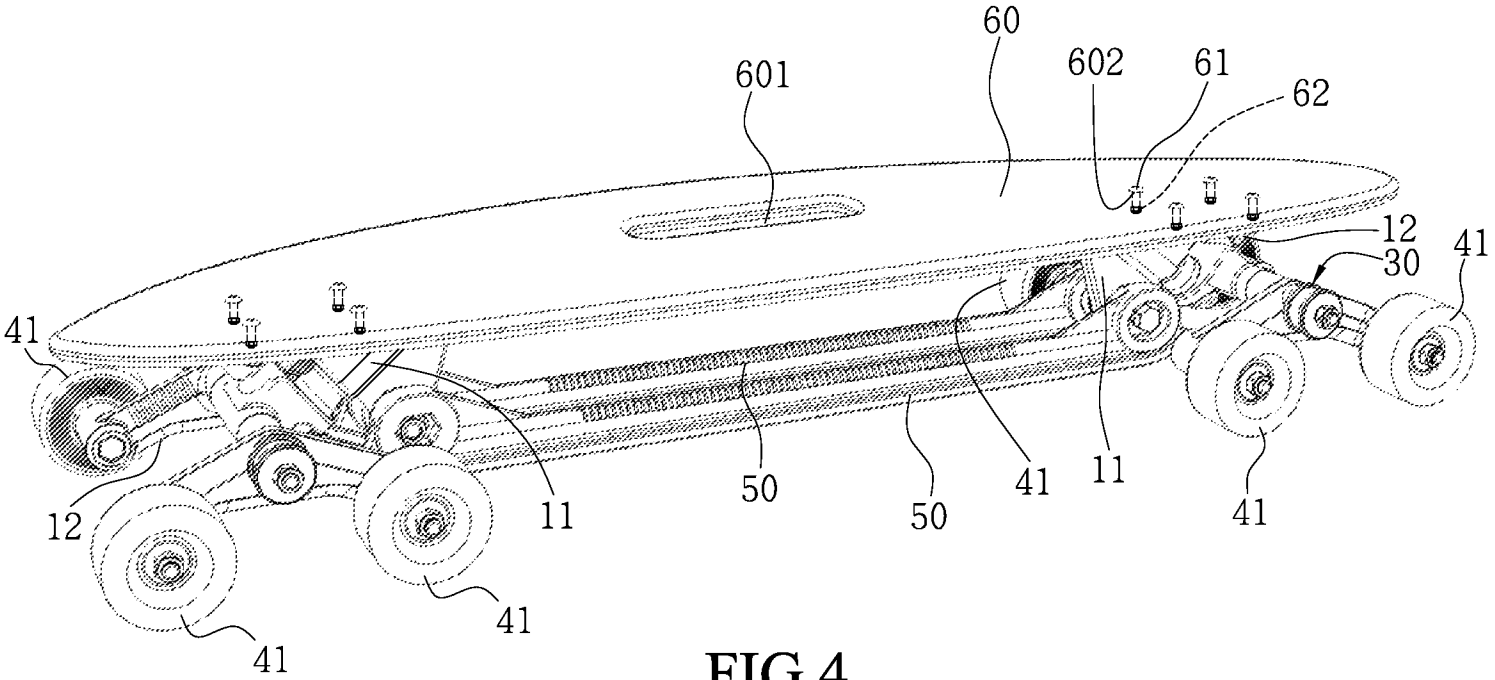
FIG. 4 is an exploded view showing a base plate, trucks, a wheel axle, wheels, a keel and a plate of a skateboard assembly according to the present invention.

Referring to FIG. 4, the skateboard assembly according to the present invention further comprises a plate 60, a plurality of sixth fastening members 61, and a plurality of seventh fastening members 62. The plate 60 is disposed with a sixth through hole 601 and a plurality of seventh through holes 602. The sixth fastening members 61 can be screws having a size corresponding to the first through hole 101 and the seventh through hole 602, and a thread (not shown) disposed in a front end thereof, and the seventh fastening member 217 can be a nut corresponding to the sixth fastening members 61, such that the sixth fastening members 61 are engaged with and fastened to the seventh fastening members 62.

Referring to FIG. 3, a plurality of sixth fastening member 61 pass through the seventh through holes 602 and the first through holes 101 corresponding to the seventh through holes 602, coupled with the corresponding seventh fastening members 62, allowing the plate 60 to be fastened to the two base plates 10, and coupled to the two wheel frames 30 and eight wheels 41 through the two ear parts 11 and two first protruding parts 12.

It should be noted that the shims can be selected to cooperate with the other members according to practical needs, or can be omitted.

In summary, the skateboard assembly according to the present invention has a keel structure that can be coupled to the base plate, and the user can use the skateboard on uneven roadways. Besides, together with the wheel axle, trucks, buffer members, retaining members and wheels to form the skateboard assembly, the user can use the skateboard on uneven roadways with higher stability.

The present invention has been described using exemplary preferred embodiments. However, it is to be understood that the scope of the present invention is not limited to the disclosed embodiments. On the contrary, it is intended to cover various modifications and similar arrangements. The scope of the claims, therefore, should be accorded the broadest interpretation so as to encompass all such modifications and similar arrangements.

What is claimed is:

1. A skateboard assembly, comprising:

a base plate having a plurality of first through holes formed on a periphery thereof;

an ear part formed on the base plate, an end of the ear part corresponding to the base plate in a position having a second through hole, wherein a first stopping part is annularly formed on an inner periphery of the second through hole;

a first protruding part formed on the base plate and having a first groove, wherein the ear part and the first protruding part are formed on a same side of the base plate, and the second through hole has a cross section orthogonal to the base plate;

a truck, including:

a second protruding part formed on a side of the truck;

a third through hole disposed on a side of the truck opposing the second protruding part, wherein a second stopping part is annularly formed on an inner periphery of the third through hole;

two axial segments perpendicular to and extending outwardly from the truck, wherein a first retaining member is formed at each of the axial segments close to the truck;

a first buffer member having a second groove mounted onto a front end of the second protruding part;

a second buffer member having a through hole;

a third buffer member having a through hole;

a first fastening member; and a second fastening member coupled with the first fastening member so as to fasten the truck to the base plate, wherein the base plate is formed with a third groove, a fourth through hole is formed on a side of the ear part facing the first protruding part, and the third groove communicates with the fourth through hole; and a wheel frame, comprising:

a pivot hole pivotally coupled with the axial segments and having a second retaining member disposed on a side of the pivot hole facing the truck and corresponding in position to the first retaining member; and first and second segments extending from two sides of the pivot hole, respectively, forming an angle, and having wheel axles disposed on ends thereof away from the pivot hole;

a third shim having a through hole;

a fourth shim having a through hole;

a fourth buffer member having a through hole and disposed between the third shim and fourth shim; and a third fastening member.

2. The skateboard assembly of claim 1, wherein the first buffer member is disposed in the first groove, the second protruding part is received in the second groove, and the first fastening member passes through the through hole of the second buffer member, the third through hole, the through hole of the third buffer member, and the fourth through hole, protrudes into the third groove, and is fastened to the second fastening member.

3. The skateboard assembly of claim 1, further comprising a first shim having a through hole; and a second shim having a through hole.

4. The skateboard assembly of claim 3, wherein the first buffer member is disposed in the first groove, the second protruding part is received in the second groove, and the first fastening member penetrates the through hole of the first shim, the through hole of the second buffer member, the third through hole, the through hole of the third buffer member, the through hole of the second shim, and the fourth through hole, protrudes into the third groove, and is fastened to the second fastening member.

5. The skateboard assembly of claim 1, wherein the axial segments pass through the pivot hole and the through hole of the fourth buffer member, and are engaged with the third fastening member, the wheel frame is axially coupled with the axial segments, and the first retaining member and the second retaining member limit axial rotation of the wheel frame with respect to the truck.

6. The skateboard assembly of claim 1, wherein the axial segments pass through the pivot hole, the through hole of the third shim, the through hole of the fourth buffer member, and the through hole of the fourth shim, and are engaged with the third fastening member, the wheel frame is pivotally coupled to the axial segment, and the first retaining member and the second retaining member limit axial rotation of the wheel frame with respect to the truck.

7. The skateboard assembly of claim 1, further comprising a plurality of wheels pivotally coupled to the corresponding wheel axle.

8. The skateboard assembly of claim 1, further comprising:

a keel having two fifth through holes formed on two opposing ends thereof, respectively, wherein a third stopping part is disposed on an inner periphery of each of the fifth through holes;

a fifth buffer member having a through hole;

a fourth fastening member; and a fifth fastening member.

9. The skateboard assembly of claim 8, wherein the fifth buffer member has two opposing sides abutting against the first stopping part and the third stopping part, respectively, the fourth fastening member passes through the fifth through hole and the through hole of the fifth buffer member, and is engaged with the fifth fastening member, and the keel is coupled with the ear part.

10. The skateboard assembly of claim 8, further comprising a fifth shim having a through hole.

11. The skateboard assembly of claim 10, wherein the fifth buffer member has two opposing sides abutting against the first stopping part and the third stopping part, respectively, the fourth fastening member passes through the fifth through hole and the through hole of the fifth buffer member, and is engaged with the fifth fastening member, and the keel is coupled with the ear part.

12. The skateboard assembly of claim 11, further comprising:

a plate provided with a sixth through hole and a plurality of seventh through holes;

a plurality of sixth fastening members; and a plurality of seventh fastening members, wherein the sixth fastening members pass the seventh through holes and the first through holes corresponding to the seventh through holes, and are engaged with the seventh fastening members, allowing the plate to be fastened to the base plate.

* * * * *